US008381480B2

(12) United States Patent
Vogt et al.

(10) Patent No.: US 8,381,480 B2
(45) Date of Patent: Feb. 26, 2013

(54) DUAL OFFSET DERRICK

(76) Inventors: Dewayne G. Vogt, Tulsa, OK (US); Jason P. Gress, Tulsa, OK (US)

( * ) Notice: Subject to any disclaimer, the term of this patent is extended or adjusted under 35 U.S.C. 154(b) by 0 days.

(21) Appl. No.: 13/160,940

(22) Filed: Jun. 15, 2011

(65) Prior Publication Data

US 2011/0302869 A1 Dec. 15, 2011

Related U.S. Application Data

(60) Provisional application No. 61/354,868, filed on Jun. 15, 2010.

(51) Int. Cl.
*E04H 12/00* (2006.01)

(52) U.S. Cl. ..... 52/651.05; 52/651.06; 52/651.07; 52/653.1

(58) Field of Classification Search .. 52/651.01–651.11, 52/633, 648.1, 652.1, 653.1, 653.2; 166/75.11–97.54; 414/22.51–22.71
See application file for complete search history.

(56) References Cited

U.S. PATENT DOCUMENTS

| | | | | |
|---|---|---|---|---|
| 3,248,958 | A * | 5/1966 | Bender | 74/89.2 |
| 3,477,235 | A | 11/1969 | Branham | |
| 3,483,933 | A * | 12/1969 | Dyer et al. | 173/39 |
| 3,749,183 | A * | 7/1973 | Branham et al. | 173/151 |
| 3,984,962 | A * | 10/1976 | Krohn | 52/651.07 |
| 4,854,400 | A * | 8/1989 | Simpson | 175/85 |
| 6,481,931 | B1 * | 11/2002 | Welsh | 405/201 |
| 6,513,605 | B1 * | 2/2003 | Lodden | 175/52 |
| 7,665,533 | B2 * | 2/2010 | Hopwood et al. | 166/380 |
| 7,802,636 | B2 * | 9/2010 | Childers et al. | 175/52 |
| 2006/0011350 | A1 * | 1/2006 | Wiggins et al. | 166/379 |
| 2007/0175134 | A1 * | 8/2007 | Christenson | 52/292 |
| 2008/0101891 | A1 * | 5/2008 | Belik | 414/22.57 |

* cited by examiner

*Primary Examiner* — Brian Glessner
*Assistant Examiner* — Adam Barlow
(74) *Attorney, Agent, or Firm* — Head, Johnson & Kachigian, P.C.

(57) ABSTRACT

An oil derrick comprising a derrick tower, where the derrick tower is asymmetrical about its z axis in both x and y directions. The dual offset derrick tower structure allows for a unique drill floor arrangement.

9 Claims, 5 Drawing Sheets

DUAL OFFSET DERRICK

CROSS REFERENCE

This application claims priority to U.S. Provisional application Ser. No. 61/354,868 filed Jun. 15, 2010.

BACKGROUND OF THE INVENTION

1. Field of the Invention

This invention relates generally to a dual offset derrick, and more particularly, but not by way of limitation, to a derrick that is asymmetrical about its z axis in both x and y directions and a complementary drilling floor arrangement.

2. Description of the Related Art

Modern energy drilling operations include a wide variety of equipment and elements that operate together and sequentially. A drilling floor supports much of the equipment and elements utilized in a drilling operation. The arrangement of equipment and elements on the drilling floor greatly influences the efficiency of the drilling.

Oil and gas drilling derricks are often supported by a hull via a cantilever. Examples of cantilever configuration include offshore platforms and offshore vessels. In such derricks, the design of the derrick tower and the layout of the drilling floor are vitally important to the balance of forces and the resulting load on the cantilever and the hull. One type of cantilever drilling derrick is utilized in offshore drilling wherein the drilling derrick is supported on cantilever beams. See, for example, Branham et al., U.S. Pat. No. 3,477,235.

Welsh, U.S. Pat. No. 6,481,931, recognizes that modern drilling realities result in overload of the cantilever, and attempts to balance the loads in a way that reduces overload. Welsh, however, requires an undesirable arrangement of elements on the drilling floor.

Based on the foregoing, it is desirable to provide a drilling derrick that allows for a more practical and efficient arrangement of elements on the drilling floor.

SUMMARY OF THE INVENTION

In general, in a first aspect, the invention relates to an oil derrick with a forward end, an aft end, a starboard side, and a port side, comprising a derrick tower, where the derrick tower has a vertical z axis, a horizontal x axis perpendicular to the z axis, and a horizontal y axis perpendicular to the x axis and to the z axis, and the derrick tower is asymmetrical about its z axis in both x and y directions.

The oil derrick may further comprise a drilling floor located below the derrick tower, where the drilling floor includes: a well center; a setback area located generally forward of the well center and two-thirds of the floor length towards the port side; drawworks located on the starboard side; a dynamic brake located aft of the drawworks on the starboard side; a driller's station located forward of the drawworks on the starboard side; and a spare line spool cantilevered off of the drill floor toward the port side of the forward end. The derrick tower may have four legs: an aft/port leg, an aft/starboard leg, a forward/port leg, and a forward/starboard leg. The drawworks may be arranged to suspend a drill string along a well centerline about one third of the floor length from the aft/port derrick leg.

The derrick tower may have an aft face extending between the aft/port leg and the aft/starboard leg, where the aft face is a flat face, and a starboard face extending between the aft/starboard leg and the forward/starboard leg, where the starboard face is a flat face. The derrick tower may have a port face extending between the aft/port leg and the forward/port leg, where the port face has a top and a bottom and where the port face at least partially angles toward the starboard side such that the top of the port face is closer to the starboard face than the bottom of the port face; and a forward face extending between the forward/port leg and the forward/starboard leg, where the forward face has a top and a bottom and where the forward face at least partially angles toward the aft side such that the top of the forward face is closer to the aft face than the bottom of the forward face.

The oil derrick may further comprise a setback area located within the derrick tower adjacent the port face. The setback area may have a forward end and an aft end and where the setback area comprises a dedicated pipe racking area located on the aft end of the setback area and a dedicated casing racking area located on the forward end of the setback area. The dedicated pipe racking area and the dedicated casing racking area may be located at different elevations within the derrick tower. The oil derrick may further comprise platforms, winches, and trolleys to accommodate manual racking.

The oil derrick may further comprise a well center line located closer to the aft/starboard leg than to the aft/port leg, the forward/starboard leg, or the forward/port leg. The oil derrick may further comprise a drilling floor, where the drilling floor comprises a well center located directly over a borehole and directly below the well center line. The drilling floor may further comprise drawworks located on the starboard side and outside the derrick tower. The drilling floor may further comprise a v-door on the forward side, a setback area located forward of the well center and two-thirds toward the port side, and provisions for offline stand building located adjacent to and forward of the setback area and outside a path between the v-door and the derrick tower.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to a dual offset derrick 13, where the derrick 13 is asymmetrical about its vertical z axis in both x and y directions, as seen in FIGS.

Figure 1:
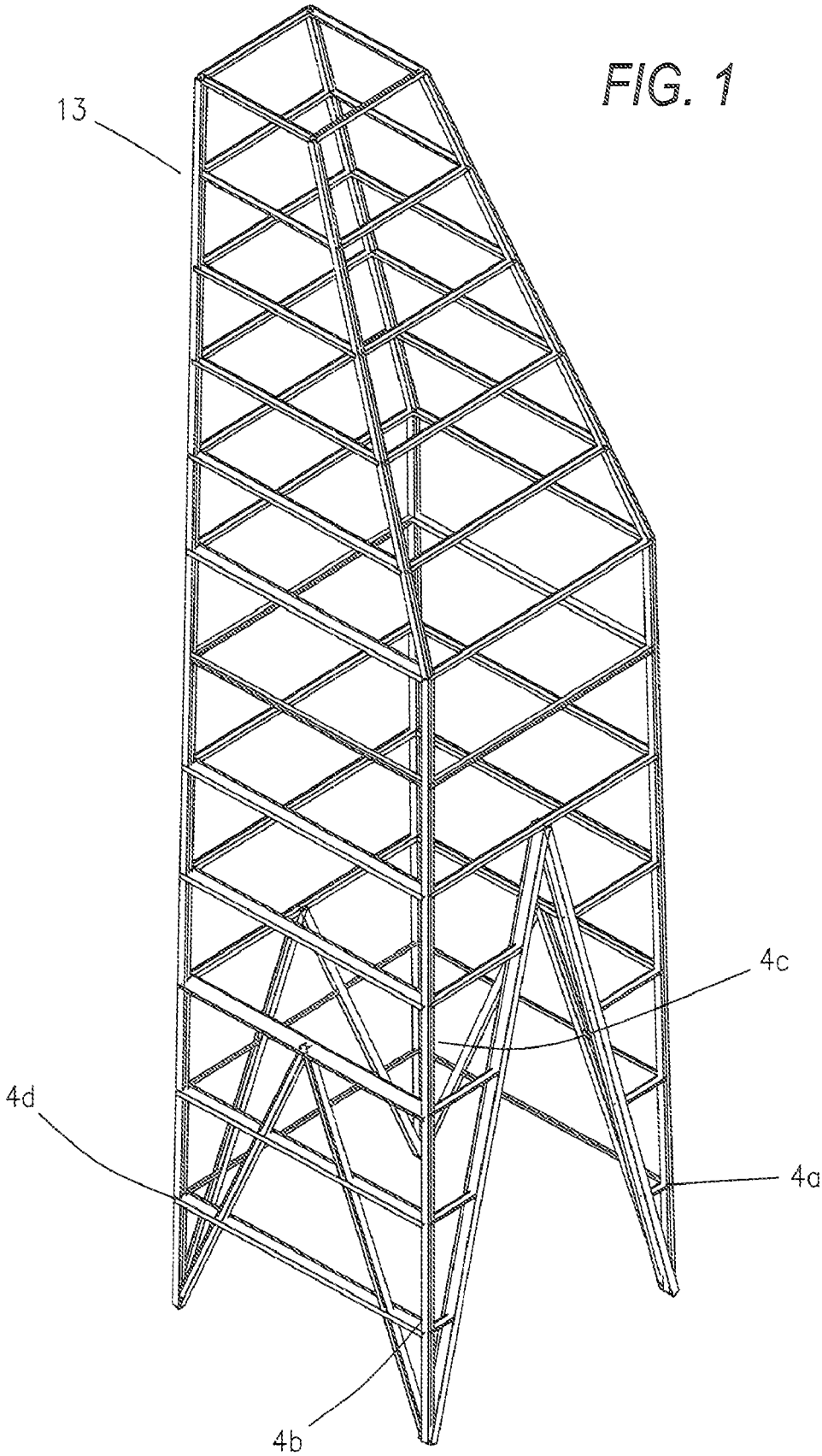
FIG. 1 is a perspective view of a dual offset derrick in accordance with the present invention.
Figures 2, 3, 4, 5:
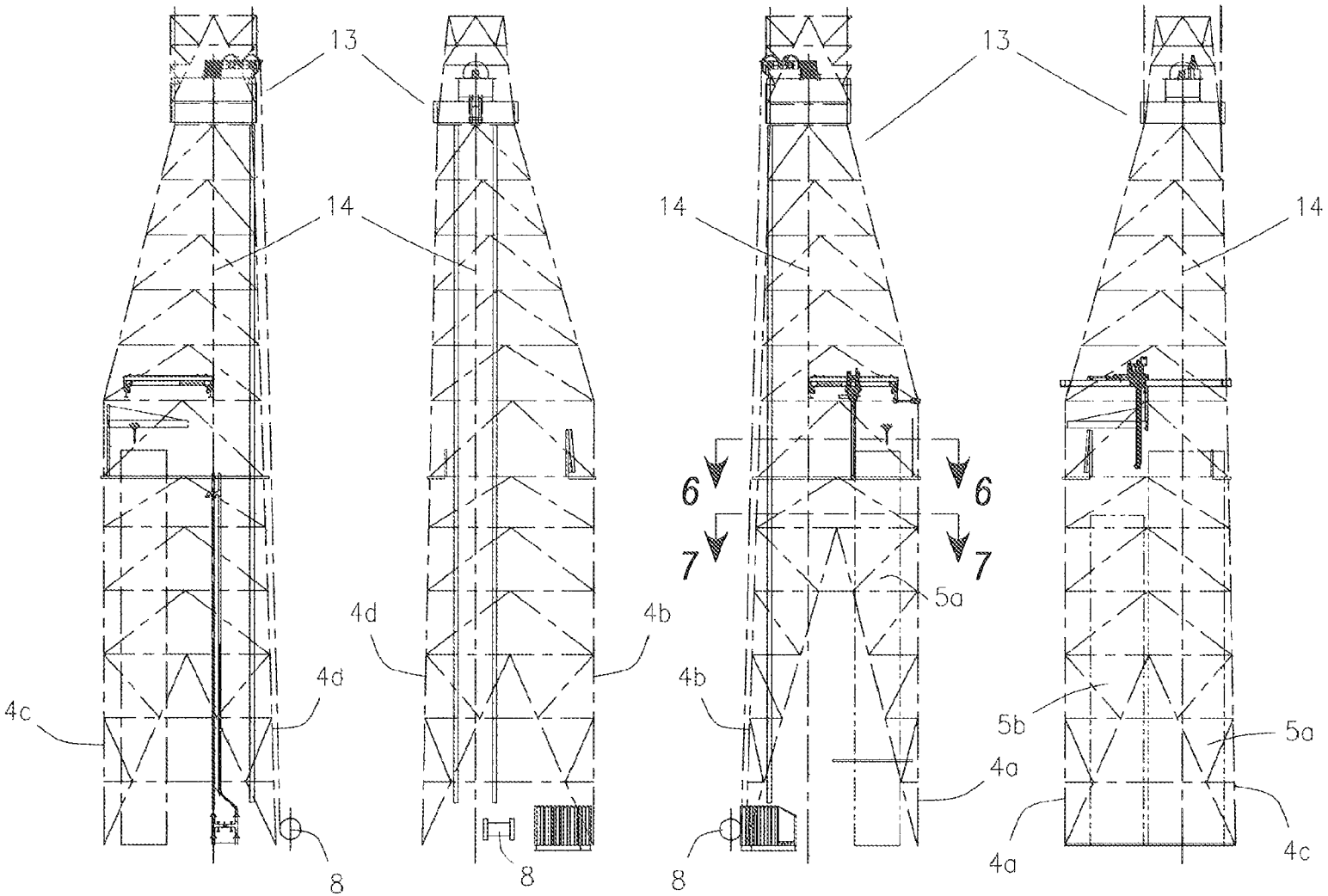
FIG. 2 is an aft side view of the dual offset derrick.
FIG. 3 is a starboard view of the dual offset derrick.
FIG. 4 is a forward view of the dual offset derrick.
FIG. 5 is a port side view of the dual offset derrick.

1 through 6. The dual offset derrick 13 has four legs 4a, 4b, 4c, and 4d. The aft face of the dual offset derrick 13, shown in FIG. 2, may extend between legs 4c and 4d and may be a flat face; in other words, the aft face may extend substantially vertically upwards without significantly angling forward or aft. The starboard face of the dual offset derrick 13, shown in FIG. 3, may extend between legs 4d and 4b and may likewise be a flat face; in other words, the aft face may extend substantially vertically upward without angling significantly toward starboard or port. The forward face of the dual offset derrick 13, shown in FIG. 4, may extend between legs 4b and 4a. The port face of the dual offset derrick 13, shown in FIG. 5, may extend between legs 4a and 4c. The forward face may initially extend substantially vertically upward, but then may angle toward aft. Likewise, the port face may initially extend substantially vertically upward, but then may angle toward starboard. Thus, the top of leg 4d may be generally located directly above the bottom of leg 4d; the top of leg 4b may be closer to leg 4d than the bottom of leg 4b; the top of leg 4c may be closer to leg 4d than the bottom of leg 4c; and the top of leg 4a may be closer to leg 4d than the bottom of leg 4a. The bottoms of legs 4a, 4b, 4c, and 4d may generally form four corners of a square, while the tops of legs 4a, 4b, 4c, and 4d may generally form four corners of a smaller square or other quadrilateral.

While the dual offset derrick 13 is described herein using the terms aft, starboard, forward, and port to refer to particular sides of the derrick 13, it should be understood that the dual offset derrick 13 may be rotated to have any desired orientation.

A well center line 14 may extend downward from a point within the quadrilateral formed by the tops of legs 4a, 4b, 4c, and 4d. Thus, the well center line 14 at the base of the derrick 13 may be located closer to the aft side and closer to the starboard side of the derrick 13 than the center of the square formed by the bottoms of legs 4a, 4b, 4c, and 4d. The well center line 14 is shown in FIGS. 2 through 5. The well center line 14 is thus offset from the center of the dual offset derrick 13 in both the x and y directions.

Figure 7:
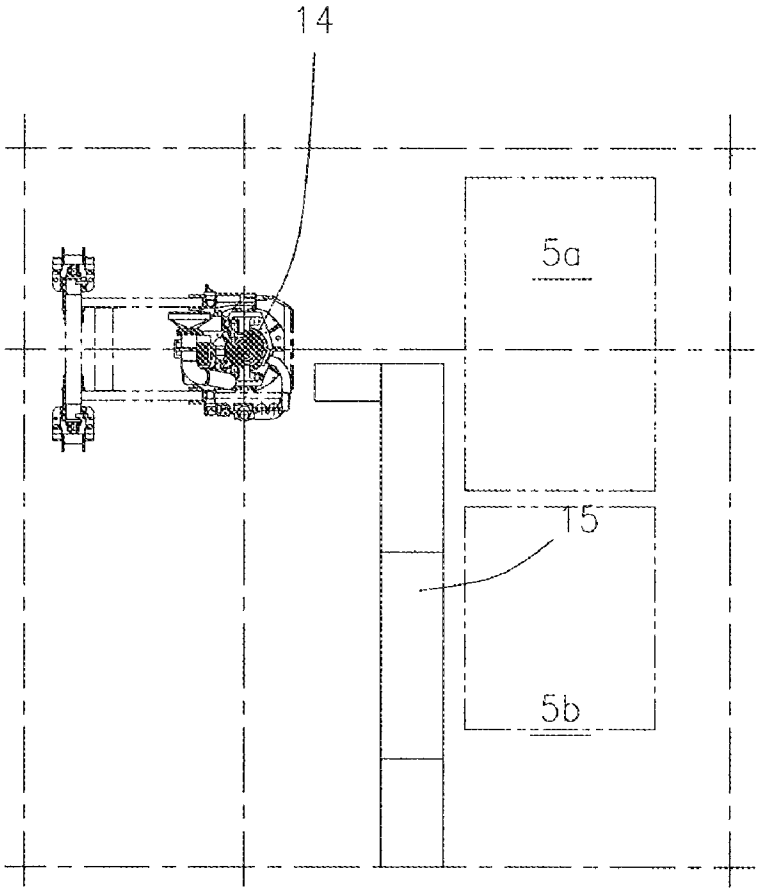
FIG. 7 is a cross-section view of the dual offset derrick at the elevation indicated in FIG. 5.
Figure 6:
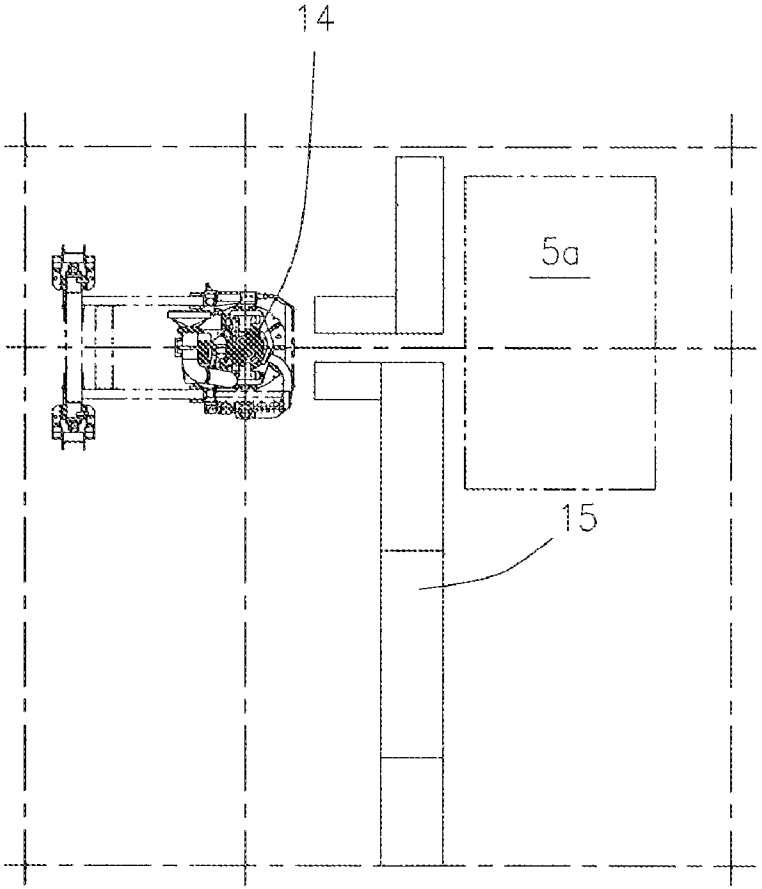
FIG. 6 is a cross-section view of the dual offset derrick at the elevation indicated in FIG. 5.
Figure 8:
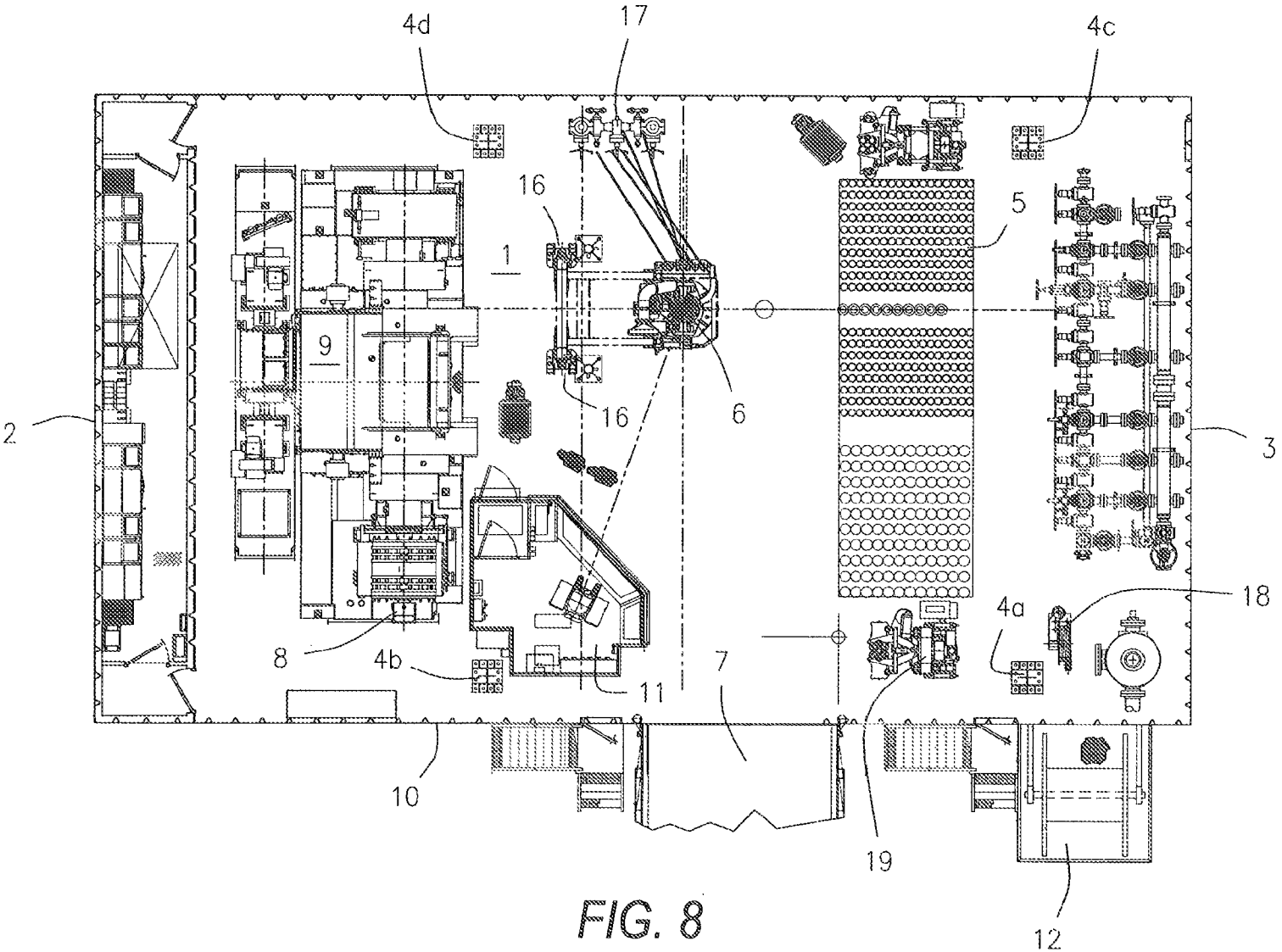
FIG. 8 is a plan view of a drilling floor with various elements thereon placed in accordance with the present invention.
Figure 9:
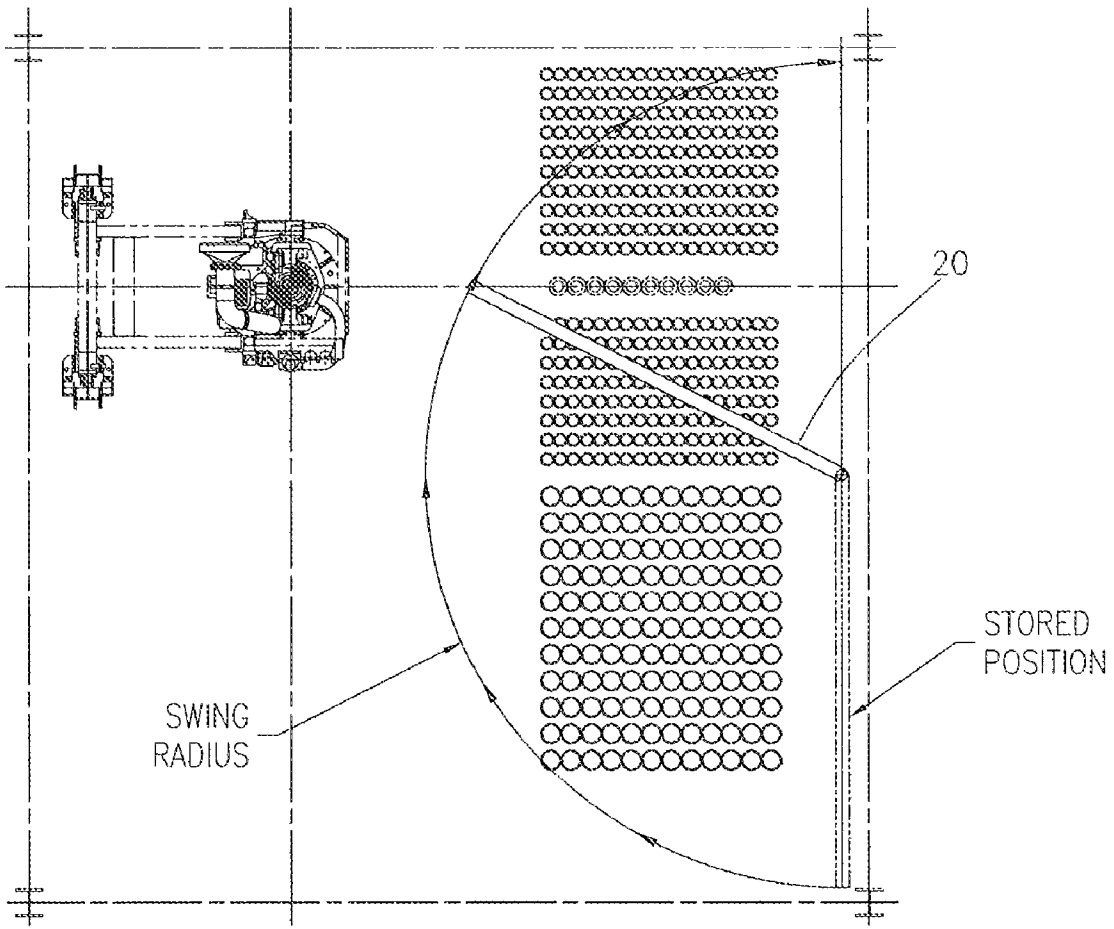
FIG. 9 is a plan view of a manual jib type racking device.

The offset well center line 14 of the dual offset derrick 13 allows for a pipe setback area 5a dedicated to racking drilling pipe, which may be located in the corner of the derrick 13 nearest leg 4c, with a separate casing setback area 5b dedicated to racking casing, which may be located in the corner of the derrick 13 nearest leg 4a. The setback areas 5a and 5b may be seen at two different elevations within the derrick 13 in FIGS. 6 and 7, which are cross-sections at the elevations indicated in FIG. 5. The derrick 13 may have platforms 15 as well as manual jib type pipe racking device 20 for racking pipe, as shown in FIG. 9. Additionally, the derrick 13 may have automated pipe racking device 21 for racking of pipe. The dedicated areas for racking drill pipe and for racking casing may be located at separate elevations in the structure.

The dual offset derrick 13 may be attached to a drilling floor 1 via legs 4a, 4b, 4c, and 4d. The drilling floor 1 may have a starboard side 2 and a port side 3. The well center line 14 of the derrick 13 may extend through a well center 6, which may be located directly over the borehole. On the drilling floor 1, the dual function setback area 5 may be located generally forward of the well center 6, two thirds of the floor area toward the port side 3. The setback area 5 may be divided into a dedicated pipe setback area 5a and a dedicated casing setback area 5b, as discussed above. The dual function setback area 5 may be in a single location, not on each transverse side of the vee-door 7.

A drawworks on a drilling rig typically includes a spool powered by a motor to reel in or out line. Drawworks 8 may be located on the starboard side 2, not the port side 3, and may be located outside the derrick, such that the drawworks 8 does not impinge on the workspace on the drillfloor and allows for the fastline to be routed up the side of the derrick without the need for deflector shivs, which add to the load on the wireline and decreases the life expectancy of the wireline. Drawworks 8 may extend upward from the drilling floor 1 and may be arranged to suspend a drill string along the well centerline 6 about one third of the floor length from the aft/starboard derrick leg 4d.

A dynamic brake 9 may be located aft of the drawworks 8 on the starboard side 2. The dynamic brake 9 may not be forward of the drawworks 8. Choke manifold equipment and degasser may be located on the port side. Guide rails 16 for traveling equipment may parallel to the side of the derrick 13 and may be located inside the derrick structure on the starboard side 2, in line with well center 6. An offline stand building machine 19 may be located adjacent to and forward of the setback area 5, allowing stand building and racking to be done outside the v-door path.

A driller's station is used for personnel and controls. A driller's station/console 11 may be forward of the drawworks 8 on the starboard side 2, not the port side 3. Locating the driller's station/console 11 on starboard allows for unobstructed visibility for the driller of operations at well center, racking in the setback area, offline stand building, and v-door activities. Stand pipe and cement manifolds 17 may be located on the aft side of the drilling floor 1, which keeps supply hoses suspended from the side of the derrick 13 and prevents the hoses from impinging driller visibility or operations within the derrick. A spare/drill line spool 12 may be cantilevered off of the forward end of the drill floor 1 on the port side 3. A deadline anchor 18 may be located outside the derrick envelope on the forward port corner of the drilling floor 1 adjacent the wireline spool 12, allowing for a short distance for the deadline to spool and keeping the deadline anchor 18 out of the work area so that it does not impinge on racking capacity or drill floor operations.

The foregoing arrangement provides several advantages. The dual asymmetrical derrick structure is unique and allows for the drill floor arrangement described. The dual asymmetrical derrick structure is also desirable because of economics and efficiency; the derrick allows for the load to be transferred through less steel. Further, the combined center of gravity of hook load and setback load is essentially on center of the structure and cantilever support beams.

One single continuous setback area simplifies pipe racking operations and allows for off-line stand-building outside of the setback work area, and clear of v-door operations. The position of the driller's console provides a clear, unobstructed view of the well center, the stand-building operation, the derrickman working at racking platform elevation, and the v-door pipe ramp and pipe catwalk. The whole operation is outside and clear of the primary v-door-well center corridor.

Whereas, the devices and methods have been described in relation to the drawings and claims, it should be understood that other and further modifications, apart from those shown or suggested herein, may be made within the spirit and scope of this invention.

What is claimed is:

1. An oil derrick with a forward or front end, an aft or back end, a starboard or right side, and a port or left side, comprising:

a derrick tower, where:

the derrick tower has four legs: a back/left leg, a back/right leg, a front/left leg, and a front/right leg;

the derrick tower has a back face extending between the back/left leg and the back/right leg, where the back face is a vertical face;

the derrick tower has a right face extending between the back/right leg and the front/right leg, where the right face is a vertical face;

the derrick tower has a left face extending between the back/left leg and the front/left leg, where the left face has a top and a bottom and where the left face at least partially angles toward the right side such that the top of the left face is closer to the right face than the bottom of the left face; and the derrick tower has a front face extending between the front/left leg and the front/right leg, where the front face has a top and a bottom and where the front face at least partially angles toward the back side such that the top of the front face is closer to the back face than the bottom of the front face; and a well center line located closer to the back/right leg than to the back/left leg, the front/right leg, or the front/left leg.

2. The oil derrick of claim 1 further comprising a drilling floor located below the derrick tower, where the drilling floor includes:

a well center;

a setback area located generally forward of the well center and two-thirds of the floor length towards the left side;

drawworks located on the right side;

a dynamic brake located aft of the drawworks on the right side;

a driller's station located forward of the drawworks on the right side; and a spare line spool cantilevered off of the drill floor toward the left side of the front end.

3. The oil derrick of claim 2 where:

the derrick tower has four legs: a back/left leg, a back/right leg, a front/left leg, and a front/right leg; and the drawworks is arranged to suspend a drill string along a well centerline about one third of the floor length from the back/left derrick leg.

4. The oil derrick of claim 1 further comprising a setback area located within the derrick tower adjacent the left face.

5. The oil derrick of claim 4 where the setback area has a front end and a back end and where the setback area comprises a dedicated pipe racking area located on the back end of the setback area and a dedicated casing racking area located on the front end of the setback area.

6. The oil derrick of claim 5 where the dedicated pipe racking area and the dedicated casing racking area are located at different elevations within the derrick tower.

7. The oil derrick of claim 1 further comprising a drilling floor, where the drilling floor comprises a well center located directly over a borehole and directly below the well center line.

8. The oil derrick of claim 7 where the drilling floor further comprises drawworks located on the right side and outside the derrick tower.

9. The oil derrick of claim 7 where the drilling floor further comprises a v-door on the front side, a setback area located forward of the well center and two-thirds toward the left side, and provisions for offline stand building located adjacent to and forward of the setback area and outside a path between the v-door and the derrick tower.

* * * * *